United States Patent [19]

Skeen, Jr.

[11] 3,995,818

[45] Dec. 7, 1976

[54] REMOVABLE SANDMILL VESSEL

[75] Inventor: Samuel Arthur Skeen, Jr., Claremont, Calif.

[73] Assignee: Morehouse Industries, Inc., Fullerton, Calif.

[22] Filed: July 16, 1975

[21] Appl. No.: 596,438

Related U.S. Application Data

[63] Continuation-in-part of Ser. No. 573,549, May 1, 1975, abandoned.

[52] U.S. Cl. ..... 241/46.11

[51] Int. Cl.² ..... B02C 23/36

[58] Field of Search ..... 241/46.06, 46.08, 46.11, 241/46.15, 46.17

[56] References Cited

UNITED STATES PATENTS

| | | | |
|---|---|---|---|
| 2,676,759 | 4/1954 | Strehlow | 241/46.11 X |
| 2,965,318 | 12/1960 | Jordan | 241/46.08 |
| 3,050,263 | 8/1962 | Barkman et al. | 241/46.17 X |
| 3,054,600 | 9/1962 | Marsh | 259/67 |
| 3,746,267 | 7/1973 | Myers et al. | 241/46.11 |

*Primary Examiner*—Granville Y. Custer, Jr.
*Attorney, Agent, or Firm*—Knobbe, Martens, Olson, Hubbard & Bear

[57] ABSTRACT

The liquid processing vessel in a sandmill is provided with lugs which fit over mating posts on a supporting column in a manner to permit the vessel to be readily removed from the support column for replacement, repair or storage. Tension on the belt driving the rotor in the vessel is easily relieved by an idler mechanism so that the rotor together with its drive shaft and pulley may be removed with the vessel as a unit. A heavy bracket at the midsection of the vessel is adapted to receive the tines of a forklift truck for handling the unit.

22 Claims, 8 Drawing Figures

REMOVABLE SANDMILL VESSEL

This is a continuation-in-part of U.S. Pat. application, Ser. No. 573,549, filed May 1, 1975 now abandoned.

This invention relates to mixing or grinding apparatus such as sandmills which mill or grind to a high degree of fineness particles within liquids. More specifically, the invention relates to an improved arrangement for mounting a sandmill vessel on a support column.

Sandmilling is a proven, practical, continuous, high production method of dispersing particles in liquids to produce smooth, uniform, finely dispersed products. One good example of this being the dispersement of pigment agglomerates in paints. The process is applicable to a wide variety of inks, dye stuffs, paper coatings, chemicals, magnetic tape coatings, insecticides and other materials where milling to a high degree of fineness is required.

In the typical sandmilling process, the material or slurry to be processed is introduced at the bottom of a processing chamber and pumped upwardly through a grinding media, which is often referred to as sand, although it is normally a small diameter manufactured grit rather than sand. Rotors positioned within the vessel forming the processing chamber grind the slurry as it is pumped through the media.

Usually the sandmill vessel is cylindrically shaped and is mounted on a supporting column with the rotor axis extending vertically parallel to the column. The motor to drive the rotor is normally mounted in the upper portion of the support column and belts are utilized to transmit the rotational force of the motor to a pulley attached to the upper end of the drive shaft that extends downwardly into the vessel where it is attached to the rotors.

A manufacturer or processor who uses a sandmill will often have more than one type of slurry which he would like to treat with the sandmill, For example, a paint manufacturer might desire to utilize a sandmill to process paints in several basic colors. Quite often, however, such production runs may not continue very long. The cost of the sandmill is such that it is usually not practical to simply buy a new sandmill for each different slurry that the user may desire to have processed. Instead, the user may elect to clean the vessel and the pump and other piping through which the slurry passes before processing the next substance. The cleaning operation takes considerable time, such as a half a day or so, and this results in considerable expense for labor and lost processing time.

Another approach for solving this problem has been to remove the vessel when a particular production run is finished and store the vessel without being completely cleaned until the same type of material is to be processed again. Such approach has some advantage in that the remaining substantial portion of the sandmill apparatus is kept in continuous use and the user only has to maintain an inventory of vessels. However, because of the system of mounting the vessel, the existing systems require considerable effort and expense in removing the vessel, transferring it to a storage area, and installing a new vessel. There are also some safety hazards in the prior art methods for handling the vessel.

For example, in one approach, the drive shaft extending through the upper end of the vessel is formed in sections so that it can be separated from the upper portion of the drive shaft that is connected to the drive means in the sandmill. Separation requires removing several bolts, which is time consuming, but of greater concern is the length of time required to reconnect the drive shaft in that the two shaft sections must be carefully aligned. To separate the vessel from the adjacent support column, a small cart is wheeled beneath the vessel to support the weight of the vessel. Nuts and bolts connecting the vessel to the support column are then disconnected so that the vessel can be wheeled away. This operation is rather precarious in that the vessel weighs several hundred pounds and is relatively tall compared to its diameter. Consequently, the center of gravity of the load is quite high and considerable care must be taken to prevent toppling of the load which would, of course, be dangerous to personnel and would damage the apparatus. Quite often, the surfaces over which such a load must be rolled are rough concrete having cracks which present further hazard for the casters of the small cart.

Consequently, a need exists for an improved method of removing and handling a sandmill vessel both from the standpoint of cost and safety. In accordance with the present invention, the vessel is mounted on a support column in a manner such that it can be easily removed by simply being lifted slightly and then moved away from the support column in a safe manner.

In a preferred arrangement, this is accomplished by providing a pair of downwardly facing V-shaped lugs on the lower end of the vessel and a similar pair of lugs on the upper end of the vessel, with the lugs being adapted to fit over horizontally extending posts mounted on the support column. Retaining members mounted on the posts define spaces with the column for receiving the lugs attached to the vessel. The rotor drive shaft which extends out of the vessel has a pulley or other driven member mounted thereon which is driven by a belt or other transmission means connected to a motor mounted on the support column. The belt is tensioned by an idler mechanism in a manner such that the tension can be easily relieved thereby permitting the belt to be removed from the pulley on the upper end of the drive shaft. Consequently, the drive shaft and the pulley can be moved as a unit with the vessel, eliminating the cumbersome operation of separating and later aligning spliced shaft sections.

It is contemplated that the vessel be removed from the support column by means of a forklift truck. Structure is mounted to the vessel near its midsection for receiving the two tines of such a truck on opposite sides of the vessel. Preferably, spring loaded pins are positioned on the vessel structure to be inserted into holes in the end of the forklift truck tines for positively attaching the vessel to the forks. With such an arrangement, it is an easy matter to elevate the vessel sufficiently to clear the retaining members on the posts and then to move the vessel horizontally away from the support column and then transfer it to its storage area.

When a vessel is to be mounted on the support column, the procedure is simply reversed, however, the advantages of the V-shaped lugs in the retaining members is particularly evident during the mounting process. The V-shape of the lugs properly centers the vessel on its supporting posts in the lateral or sideways direction with respect to the supporting column. Also, the retaining members are preferably formed with a conical or tapered surface on their sides facing the support column. When the V-shaped lugs engage this surface, they are biased towards the support column so that vertical portions of the lugs are engaged flush against the support column. Thus, it is a simple matter to align the lugs on the vessel with the posts and lower the vessel into position. Because of the adjustable idler mechanism for applying tension on the belts, it is easy to slip the belts over the pulley on the drive shaft so that the rotor is once more operational. As a further point of simplification, any connections to the vessel for the slurry being processed or for cooling water can be made by quick disconnect couplings. It has been found that the entire operation can be performed in a matter of a few minutes by one relatively unskilled forklift truck operator.

Most sandmills are from eight to ten feet high and the drive mechanism for the vessel rotor is located at the upper end of the apparatus. Thus, in disconnecting or connecting the drive means, it is necessary for a person to reach the top of the unit. For this purpose the apparatus is conveniently provided with ladder rungs on a back cover, which also encloses the drive motor and idler equipment. By acoustically insulating the cover, the noise level surrounding the apparatus is lowered, which is desirable for many reasons including meeting governmental requirements.

For a more thorough understanding of the advantages and operation of the invention, refer to the following detailed description and drawings in which.

Figure 1:
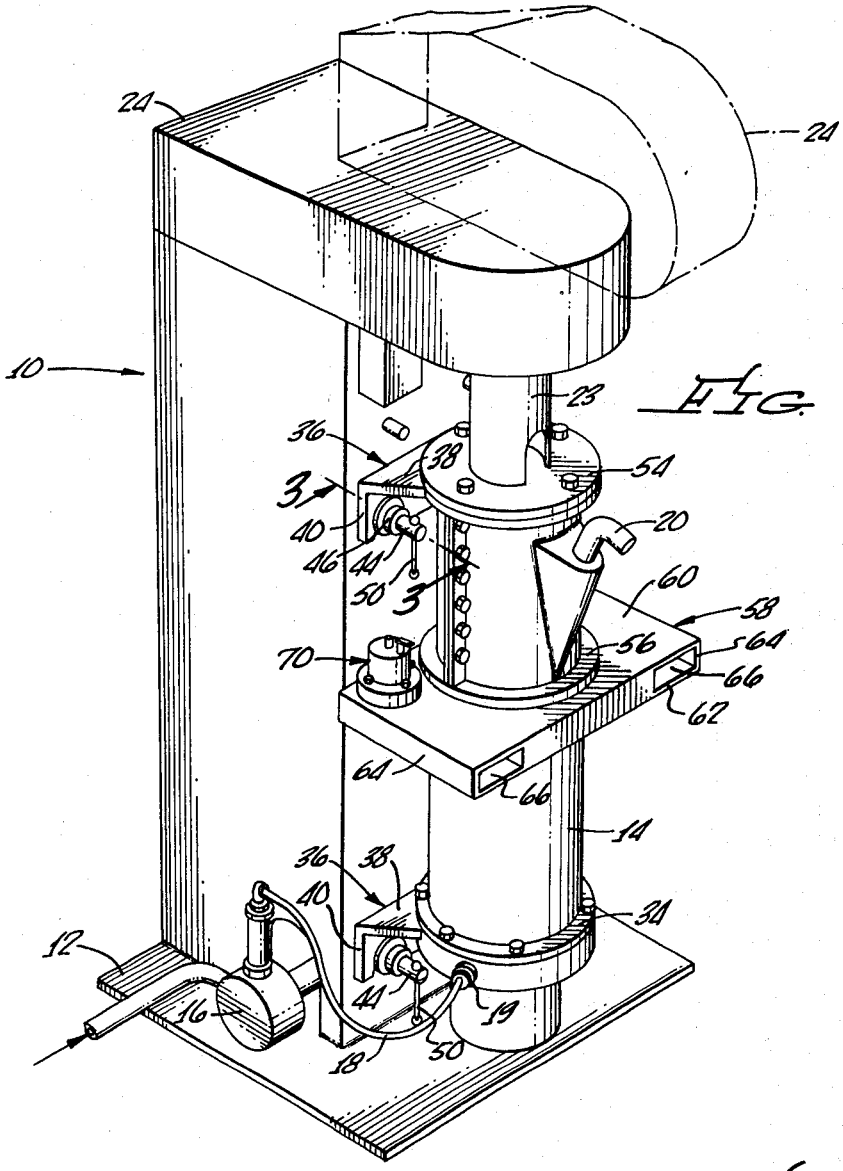
FIG. 1 is a perspective view of the sandmill of the invention.

Referring to FIG. 1, the sandmill apparatus shown includes a support column or pedestal 10 mounted on a platform or base 12. The column has a rectangular cross-section and is made of heavy metal plate to support the weight of a cylindrical vessel 14 vertically oriented and mounted on the support column 10. Liquid to be processed through the vessel 14 is moved by a pump 16 supported on the column 10 and driven by a motor 17 positioned within the column. The output from the pump 16 is ducted by a hose 18 to an inlet in the lower end of the vessel 14 and pumped upwardly through the vessel and out a pipe 20 on the upper end of the vessel.

Figure 5:
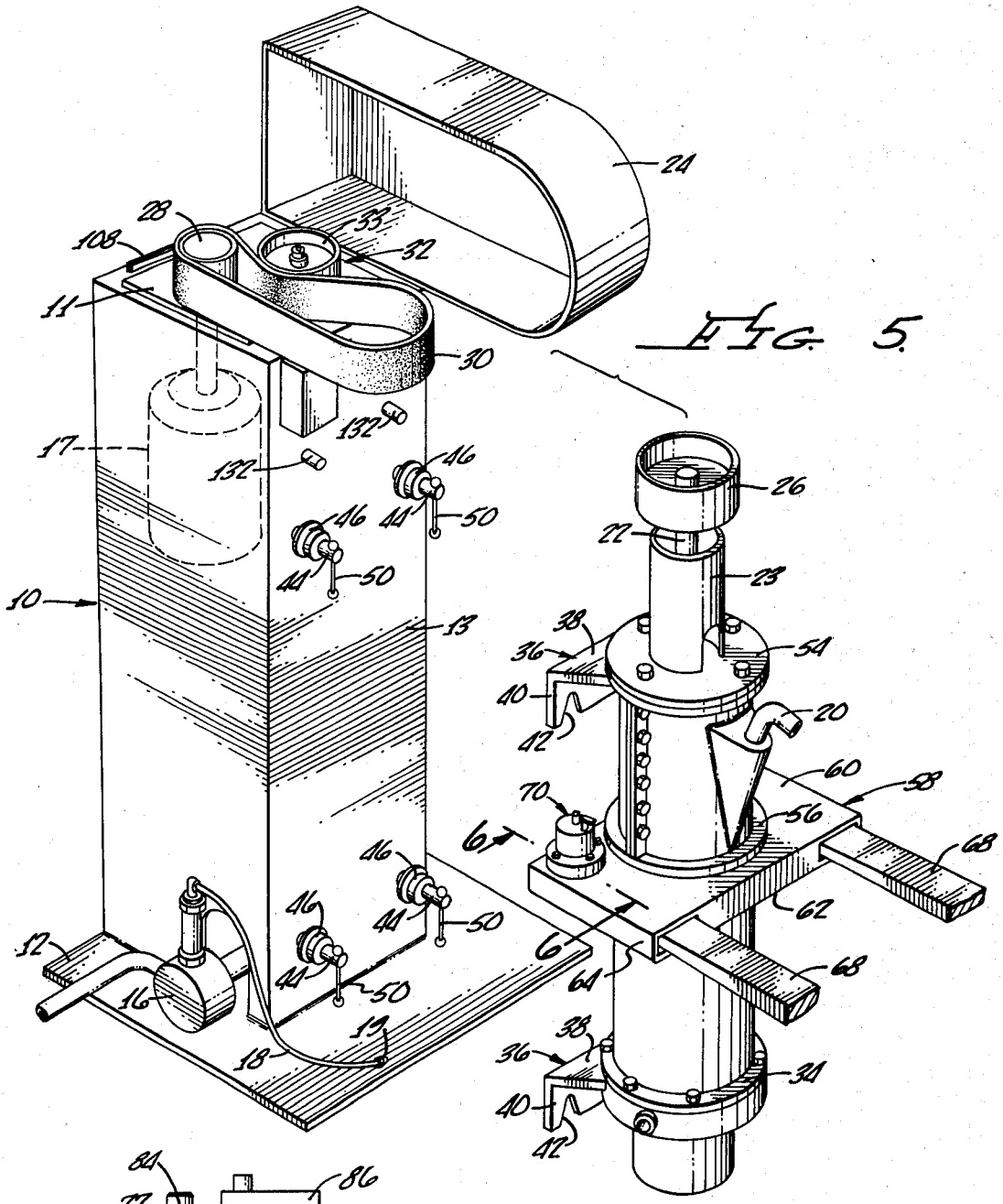
FIG. 5 is an exploded perspective view illustrating the manner in which the sandmill vessel is removed from the support column.

Within the vessel 14, there are a plurality of rotors (not shown) mounted on a shaft 22, FIG. 5, which extends out the upper end of the vessel through a tubular housing 23 and into a transmission housing 24 mounted on the upper end of the support column 10. Also shown in FIG. 5 is a driven pulley 26 mounted on the upper end of the shaft 22 and a driving pulley 28 mounted on the upper end of the motor. A belt 30 transmits the driving force from the pulley 28 to the pulley 26. An idler pulley assembly 32 including an idler pulley 33 mounted on the upper wall 11 of the support column 10 provides tension to the belt 30. As can be seen from FIG. 5, the housing 24 is mounted by hinges or other suitable means so that it may be swung open.

The operation of a sandmill is well known. While the material to be processed is being pumped upwardly through the vessel, the rotors within the vessel are rotated by the drive means as described. The rotors agitate a grinding media usually referred to as sand, although it is typically a manufactured grit. The combination of the moving grit plus the fluid being pumped under pressure through the media mills or grinds the particles within the liquid so that the resulting product is very fine and well mixed.

Figure 2:
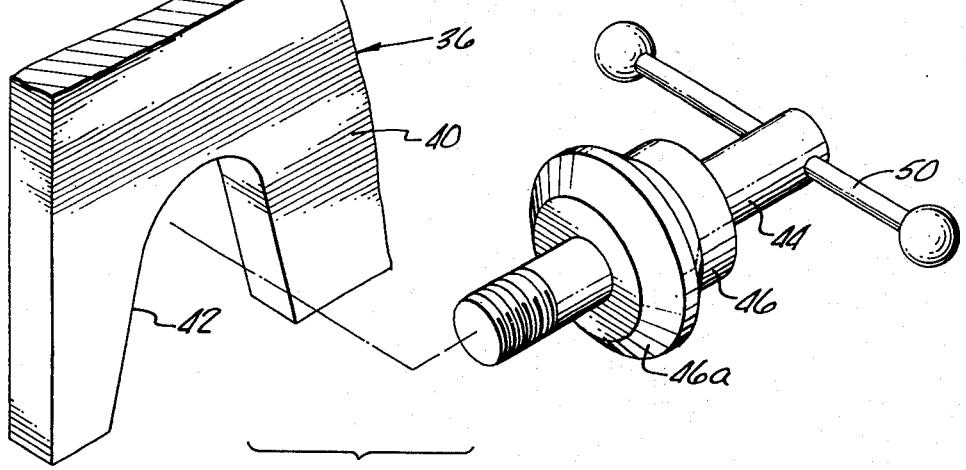
FIG. 2 is an exploded perspective view of a supporting lug on the vessel together with a supporting post and retaining member attached to the support column.
Figure 3:
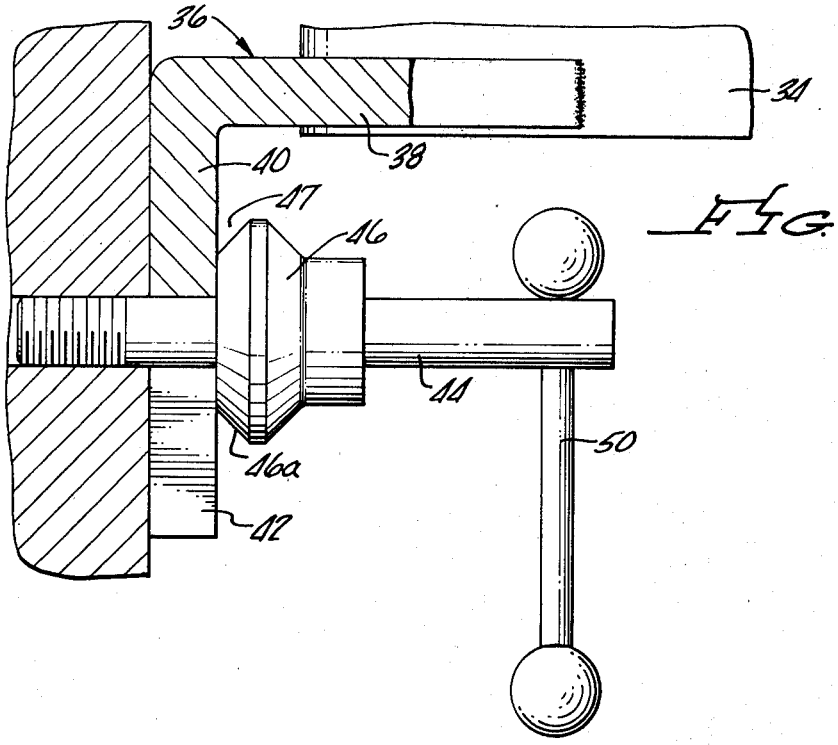
FIG. 3 is a side cross-sectional view on line 3—3 of FIG. 1 further illustrating the nature of a lug and the support posts.

As explained above, it is often desirable to switch from processing one material to another. To do this with the same vessel, it is necessary to clean the vessel which takes considerable time. In many cases it is preferable to move the vessel and store it until that same material is to be processed. During the interim a different vessel is mounted on the support column for processing the next material. The vessel 14 in FIGS. 1 and 5 is mounted in a manner to be readily removable. Lugs 36 are attached to an annular flange 34 at the lower end of the vessel. As best seen in FIG. 3, each lug 36 includes a horizontally extending portion or flange 38 and a vertically depending portion 40. The depending portion 40 includes a downwardly facing V-shaped notch or recess 42 which may be seen enlarged in FIG. 2. Lugs 36 each having a notch 42 of this type are positioned on opposite sides of the vessel 14. Actually, the horizontal portions 38 are formed as a single flange extending across the vessel 14. Each notch fits over a post 44 which extends horizontally from the support column 10. A retaining member 46 is mounted on the post 44 so that together the retaining member 46 and the adjacent wall of the support column 10 define a space 47 for receiving one of the V-shaped notches 42. As can be seen, the retaining member 46 has a frustoconical surface 46*a* which is tapered towards the support column 10 as best seen in FIG. 3. The post is threaded in the support column and a handle 50 is mounted on the outer end of each post to turn the post and thus move the retaining member 46 toward and away from the support column to properly position the member 46.

The upper end of the vessel 14 is similarly provided with a pair of lugs 36 attached to an upper flange 54 on the vessel. The downwardly extending V-shaped notches on opposite sides of the vessel 14 cooperate with a pair of posts 44 extending horizontally outwardly from the support column in a manner similar to that for the lower lugs.

Attached to a flange 56 at the midsection of the vessel 14 is structure 58 for carrying the vessel, including a pair of spaced, horizontal plates 60 and 62 which extend on opposite sides of the vessel and are joined by short sidewalls 64 which define, with the vessel, passages 66 for receiving the tines 68 of a forklift truck as may be seen in FIGS. 1 and 5.

Figure 6:
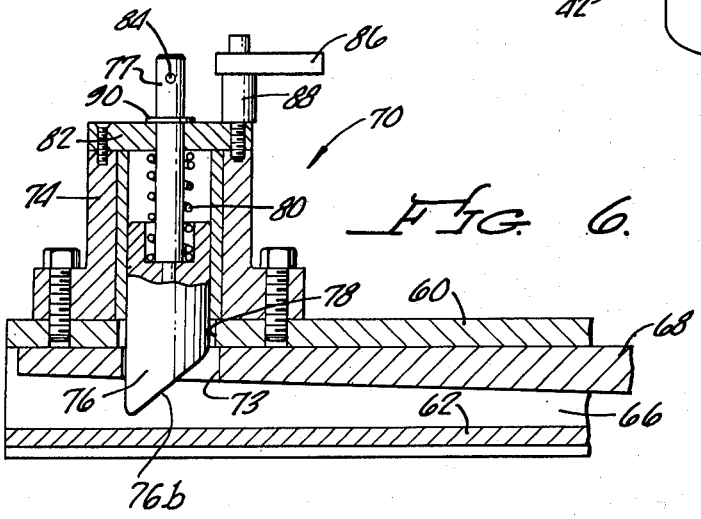
FIG. 6 is a cross-sectional view on lines 6—6 of FIG. 5 illustrating the cooperation between the forklift tines and the spring-loaded retaining pins.

Mounted on the upper plate 60 over each of these passages is a locking pin assembly 70 for securing the vessel to the tines 68 of the forklift truck. More specifically, there is shown in FIG. 6 an annular housing 74 having a retaining pin 76 vertically positioned therein which extends downwardly through a hole 78 in the horizontal plate 60. Included in the assembly 70 is a compression spring 80 which extends between the upper end of the pin 76 and a cap 82 on the upper end of the annular housing 74. The spring 80 urges the retaining pin 76 downwardly into the passage 66 to be in the path of the tine 68 of the forklift truck. As can be seen, the lower end 76b of the retaining pin is beveled in the direction away from the support column 10 and towards the tip of the forklift truck tine 68 as it is inserted into the passage 66. Consequently, the bevel on the pin will cause the tine of the forklift truck to push the pin upwardly out of the way of the tine. The tine is formed with a hole 73 in its tip as may be seen from FIG. 6. Thus, when the pin 76 becomes aligned with the hole 73, it will snap downwardly into the hole, thereby locking the forklift truck tine 68 to the upper plate 60 and thereby locking the tine to the vessel 14.

A pin extension 77 extends upwardly through the upper cap 82 of the annular housing. A handle 84 comprising a second smaller pin extends crosswise through the retaining pin 76 to provide a manual grip for the operator to raise the pin if desired. Also mounted on the upper end of the lock assembly 70 is a retaining latch 86 which is mounted on the annular housing by means of a sleeve and bolt 88 to be pivoted in a horizontal plane. With the pin 76 retracted, the retaining latch 86 may be pivoted to extend beneath a retaining ring 90 mounted on the pin 76 so that the latch can hold the pin in its retracted or unlocked position. To allow the locking to occur automatically by means of the spring loading, it is only necessary to pivot the latch out of engagement so that the pin is free to be forced downwardly. The retaining ring 90 also limits the downward travel of the pin 76 by engaging the cap 82. If a yet more positive lock is desired when the pin 76 is in the hole 73 of the tine 68, the latch may be pivoted over the upper end of the handle 84. Thus, the latch would be in the path of the pin 76 and prevent it from being forced upwardly.

Figure 4:
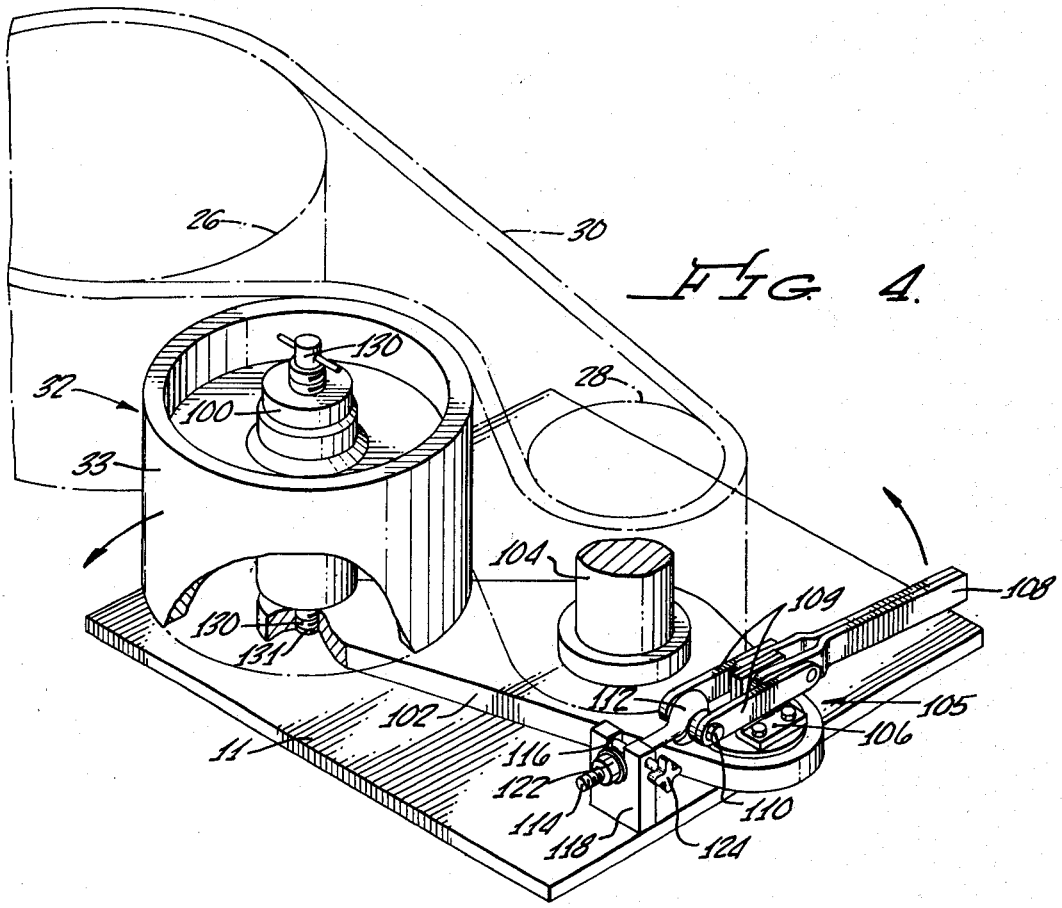
FIG. 4 is a perspective view of the idler release mechanism for the belt drive means.

Turn now to FIG. 4 for a description of the adjustable idler pulley assembly 32. The idler pulley 33 is rotatably mounted on a shaft 100 supported on a horizontal plate 102 which is pivotally mounted around the motor shaft 104. Mounted on the plate 102 on the opposite end from the idler pulley 33 is a quick operating mechanism 105 for pivoting the pulley 33 into engagement with the belt 30 to apply tension to the belt. This mechanism 105 which operates on an over-center pivoting principle includes an upwardly extending bracket 106 which is mounted on the pivotal plate 102. A handle 108 is mounted to the bracket 106 to be pivoted in a vertical plane as indicated by the arrow in FIG. 4. The lower end of the handle is bifurcated so that it straddles the support bracket 106. A pair of links 109 is positioned on the outside of the bifurcated end of the handle and pivotally attached to the handle 108. The other ends of the links are connected by a pin 110 on which is mounted the eye 112 on the end of a heavy eye bolt 114. The other end of the bolt 114 is positioned within a slot 116 formed in an upwardly extending lug 118 attached to the upper end 11 of the support column 10. A nut 122 threaded onto the end of the bolt 114 engages the side of the upwardly extending lug 118. A safety pin 124 extends through the upper ends of the upwardly extending lug 118 to hold the connecting bolt in the position shown in FIG. 4.

The idler pulley mechanism 32 is shown in FIG. 4 in its position wherein operating tension is applied to the belt. It can be seen that the plate 102 may be rotated clockwise to force the pulley to apply further tension to the belt. That tension may be adjusted by the nut 122 threaded onto the end of the bolt 114. However, the nut is utilized for only occasional adjustment of the tension. To release or apply tension on the belt quickly, the safety pin 124 is withdrawn and the lever or handle 108 is pivoted upwardly in the direction indicated by the arrow. The ends of the links 109 attached to the handle are similarly moved in the direction of the arrow so that the other ends of the links can be moved to the left as viewed in FIG. 4. In this position, the tension applying mechanism is no longer applying a clockwise force to the pivotally mounted plate. Consequently, the idler pulley 33 may be easily moved away from the belt 30 enabling the belt to be removed from the driven pulley 26 on the upper end of the sandmill shaft. This movement of the tension applying assembly requires the connection between the eye bolt and the pin 110 on the end of the links 109 to move upwardly somewhat which is the reason that the safety pin 124 must be removed. Correspondingly, when tension is to be applied to the belt, it is a simple matter to pull the handle downwardly to apply a clockwise force on the plate 102 carrying the idler pulley 33. The connection between the links 109 and the handle 108 is such that when the handle is in its lowest position, as shown in FIG. 4, the force applied is below the pivotal axis of the handle with respect to the upwardly extending bracket 106. Consequently, the handle 108 wants to remain in that tension applying position. The safety pin 124 is only utilized as an additional precaution.

The idler pulley 33 which is rotatably mounted on its shaft 100 may be further locked in its tension applying position. This is accomplished by a retaining pin 130 which extends through the idler pulley 33 and mates with a hole 131 properly aligned in the upper wall 11 of the support column 10.

From the foregoing, the operation of the removable support assembly for the sandmill vessel is probably readily apparent. Nevertheless, the steps will be briefly summarized. If the vessel 14 is to be removed from its position as shown in FIG. 1, the tines 68 of a forklift truck are inserted into the passages 66 in the structure attached to the midsection of the vessel. The ends of the tines 68 will engage the spring mounted lock pins 76 forcing them upwardly out of the way until they become aligned with the holes 73 in the ends of the tines, at which times they will snap downwardly into the position shown in FIG. 6. The housing 24 on the upper end of the support column is then swung out of the way to the position as shown in FIG. 5. The idler pulley 33 has been pivoted out of engagement with the belt 30 by lifting the tension relieving handle 108 shown in FIG. 4. It is then a simple matter to slip the ends of the belt 30 over the driven pulley 26 on the upper end of the rotor shaft 22. The hose 18 feeding the slurry into the vessel is disconnected by means of a suitable quick disconnect coupling 19. Also any other fluid connections to the vessel may be similarly quickly disconnected. For example, the vessel normally has a jacket through which cooling water flows such that there would be an inlet and outlet hose for the cooling jacket. For simplicity, these hoses are not shown in the drawing.

The handles 50 on the support posts 14 are now backed off slightly from the V-shaped lugs 36, and the vessel 14 is free to be removed by means of the forklift truck. To do this, it is necessary to raise the vessel slightly so as to clear the V-shaped lugs 36 from the retaining members 46 on the support posts 44. The vessel together with the rotor shaft 22 and its pulley 26 is then free to be moved as a unit and taken to a storage area by the forklift truck, as is illustrated in FIG. 5. This entire operation may be accomplished by one relatively unskilled operator in a few minutes.

Since in some situations, it may be necessary to position connections or other structure on the side 13 of the support column facing the vessel 14, it is desirable to position two stops 132 on the support column spaced above the upper support posts 44 as shown in FIG. 5. These stops limit the upward movement of the lugs when the vessel is being removed so as to prevent damage to any structure that may be located on the support column.

When a vessel is to be reinstalled on the support column, the procedure is, of course, simply reversed. As mentioned above, the V-shaped notches 42 in the supporting lugs 36 on the vessel 14 cooperate with the retainer member 46 and the support posts 44 on the support column 10 so as to quickly and positively position the vessel in its proper orientation. The tapered surface 46a of the member 46 helps guide the lugs into position. The drive pulley 26 may then be simply slipped into position and tension applied to the belt 30 through the pulley 33 by downwardly pivoting the handle 108 on the tension applying mechanism 105. Rotating the posts 44 moves the retaining members on the support posts towards the support column to hold the lugs positively in engagement with the support column. While the posts are shown threaded to the column 10 in the drawings, a variety of systems could be utilized for moving the retaining members, including a cam mechanism, which would take even less time to operate. After once more connecting the liquid lines to the vessel, the sandmill is ready to be operated.

Figure 7:
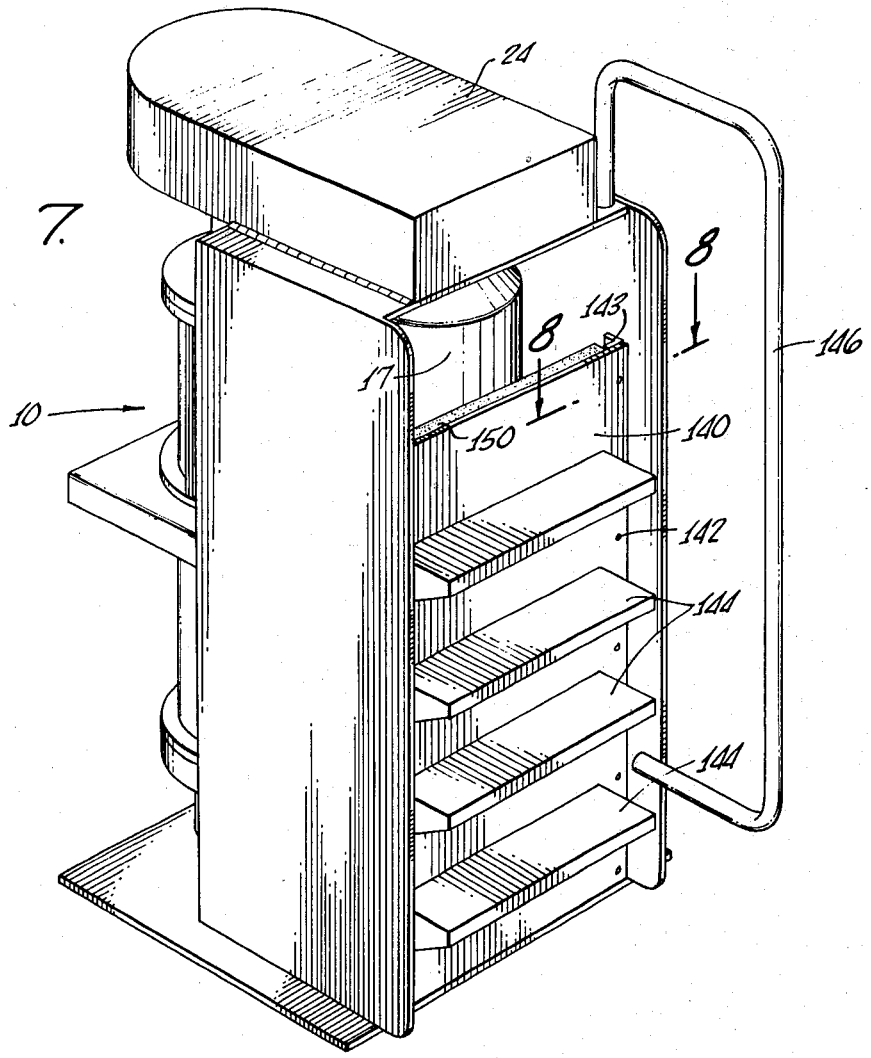
FIG. 7 is a perspective view of the rear of the sandmill illustrating the rear cover and ladder.
Figure 8:
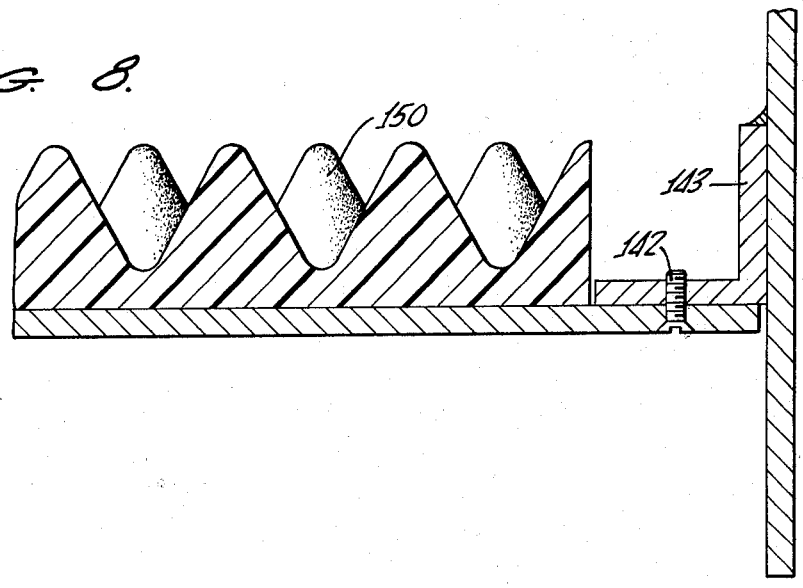
FIG. 8 is a cross-sectional view of the cover on lines 7—7 of FIG. 8.

FIG. 7 illustrates a convenient feature for a sandmill which is not shown in FIGS. 1 and 5. The sandmill illustrated in FIG. 7 has an exterior slightly different from that of FIG. 1, but the removable vessel features are the same, hence the same members will be used for both. A door or cover 140 is shown completely enclosing most of the rear side of central column 10 opposite from the vessel side. The upper portion of the rear side beneath the housing 24, is left open to provide cooling air circulation for the rotor drive motor 17. The cover 140 is conveniently mounted on the column 10 by suitable means such as readily removable screws 142, threaded into angle brackets 143 which are attached to the sides of the column. Steps or ladder rungs 144 are mounted directly on the lower portion of the cover. A hand rail 146 is mounted adjacent the steps on the side of column 10 opposite from the location of the hinge for the transmission housing 24. One end of the rail is attached to the housing top wall and the other end is attached to the side wall near the upper steps.

The steps 144 and hand rail 146 enable a person to quickly, easily and safely reach the housing 24 and pivot it to its open position. The idler release handle 108 is then accessible as is the drive belt 30 so that the belt can be easily removed from the pulley 26. Most sandmills are from eight to ten feet high. Thus, in order to conveniently reach the pulley 26 on the upper end of the rotor shaft, the operator must reach up and forward a considerable distance. The steps are an important part of the fast but safe vessel removal and installation feature.

The rotor motor 17 and the motor for the pump 16 produce considerable noise during operation. Frequently, a sandmill is utilized in an area with other sandmills or with other equipment. It is important that the noise level be minimized wherever practical; and in some cases governmental regulations make this mandatory. Enclosing the rear of the central column helps considerably in reducing the noise level. Providing suitable sound absorbing material 150 on the inner wall of the cover further minimizes the noise.

What is claimed is:

1. Industrial apparatus for processing liquids comprising:

a support structure;

a vertically oriented vessel positioned to the side of said structure for receiving sand or other such grinding media and liquid to be processed within said vessel;

a rotor in said vessel for agitating the grinding media and the liquid;

a rotor drive shaft extending vertically out one end of the vessel and a driven member attached to the shaft exterior of the vessel;

a motor mounted on said support;

transmission means driven by said motor and connected to said driven member to rotate said rotor shaft;

means for enabling said transmission means to be quickly disconnected from said driven member so that the rotor shaft and the driven member may be separated from the support as a unit with the vessel;

means attached to said vessel for receiving the tines of a forklift truck so that said unit may be readily moved to or from said support; and cooperating mounting means extending from the side of said vessel and from said support for quickly mounting said vessel on said support including means for guiding the vessel into mounted position which enables the operator of said forklift truck to position single-handedly the vessel on the support.

2. The apparatus of claim 1 wherein said driven member is a pulley mounted on the shaft, said transmission means is a belt and said enabling means is an adjustable idler mechanism mounted on the support.

3. The apparatus of claim 1 including means mounted on said vessel for locking the forklift truck tines to the vessel during the moving operation.

4. The apparatus of claim 2 wherein said support is a hollow column and said motor is mounted within the upper end of said column; and including a cover removably attached to said column on the side of the column opposite from said vessel to enclose the column and provide ready access to the interior of the column, said step means being mounted on said cover.

5. The apparatus of claim 4 including a hand rail on the upper portion of said column adjacent said step means.

6. The apparatus of claim 1 wherein said means for enabling said transmission means to be connected is manually operated and is located on the upper end of said support; and including step means on said support to provide ready access to said enabling means.

7. Apparatus for processing liquids comprising:

a vertically extending support column;

a vertically oriented vessel positioned to the side of said column; and means attached to the sides of the column and the vessel for supporting said vessel on said column in a manner such that the vessel can be readily removed from the column by simply being lifted slightly and then moved horizontally away from the column, said means for supporting said vessel comprises a plurality of V-shaped lugs mounted on one of said support and said vessel and a plurality of support posts mounted on the other of said support column and vessel with the lugs and posts cooperating to support the vessel on the column.

8. The apparatus of claim 7 including retainer means on said posts spaced from the structure supporting the posts for defining spaces for receiving said lugs.

9. The apparatus of claim 8 wherein said retainer means on said posts includes a tapered surface which urges the lugs and the structure supporting the posts into engagement.

10. Apparatus for grinding or processing liquids comprising:

a support column;

a generally cylindrical vessel for receiving liquids to be processed, said vessel being vertically oriented adjacent the support column;

a pair of spaced supporting lugs attached to the lower portion of said vessel and a pair of spaced lugs attached to the upper portion of said vessel, each of said lugs including a horizontally extending portion attached to the vessel and a vertically extending portion to engage the support column, said vertically extending portion having a V-shaped cross-section with the V opening downwardly;

a plurality of posts attached to said support column extending outwardly from the column and being spaced and positioned so that the V-shaped portion of each of said lugs will straddle one of said posts;

a retaining member mounted on each of said posts spaced from said column to define a space between the column and the retaining members for receiving each of said lugs.

11. The apparatus of claim 10 wherein said retaining members have a tapered surface facing the column to be engaged by one of said lugs with said taper being oriented so that the lugs are urged toward the column.

12. The apparatus of claim 10 including:

a rotor drive shaft extending vertically through the upper end of said vessel;

a pulley mounted on the upper end of said shaft;

a motor mounted in the upper end of said support column;

belt means transmitting power from the motor to the pulley;

idler means movably mounted on said column to be quickly and easily moved so as to apply or release tension on said belt and thereby permit the belt to be readily removed from the pulley so that the vessel together with the shaft and the pulley may be quickly removed from the support column.

13. The apparatus of claim 12 wherein said idler means includes:

a support plate pivotally mounted on the upper wall of said column;

an idler pulley rotatably mounted on said support plate horizontally aligned with the belt; and means mounted on said upper wall and on said plate for pivoting the plate in a manner to move the idler pulley in a manner to apply tension to said belt or to release tension on said belt.

14. The apparatus of claim 13 wherein said means for pivoting said plate includes a mechanism operable by a single pivotally mounted handle to pivot said plate.

15. The apparatus of claim 12 including steps mounted on said support column to enable an operator to conveniently reach said idler means and said pulley.

16. The apparatus of claim 15 including a cover enclosing the side of said support column opposite from said vessel, said steps being supported on said cover.

17. The apparatus of claim 10 including structure attached to said vessel intermediate the upper and lower lugs on the vessel for receiving the tines of a forklift truck utilized to remove the vessel from the column.

18. The apparatus of claim 17 including means mounted on said structure for locking the tines to the structure.

19. The apparatus of claim 17 including spring-loaded pin means mounted on said structure so that a pin may be inserted into the end of each forklift truck tine so as to positively lock the tines to the container when it is being moved.

20. The apparatus of claim 19 wherein said spring-loaded pin means includes a spring urging the pin into locked position and including means for manually retracting the pin into an unlocked position.

21. The apparatus of claim 20 wherein the ends of said pins are beveled so that they may be pushed into retracted position by the tines of the forklift truck as the tines are moved perpendicular to the pins, so that the pins will automatically snap into the holes in the tines when the holes in the tines become aligned with the pins.

22. Grinding apparatus comprising:

a support;

a generally cylindrical vessel for receiving a grinding media and liquid to be processed through said vessel;

a rotor in said vessel for agitating the media and the liquid, and a rotor drive shaft supported on said vessel and extending upwardly out the upper end of said;

means mounted on said support and releasably connected to drive said shaft;

mounting means on said vessel and extending outwardly from said support for supporting the vessel on said support; and means mounted on the mid-section of said vessel on each side of said vessel for receiving the tines of a forklift truck to enable the vessel together with the rotor and drive shaft to be readily removed from the said support after said drive shaft is disconnected from said drive means.

* * * * *